US005766689A

United States Patent [19]

Ono

[11] Patent Number: 5,766,689

[45] Date of Patent: Jun. 16, 1998

[54] SPRAY OPERATION METHOD FOR MONOLITHIC REFRACTORIES

[75] Inventor: Yasushi Ono, Hyogo-ken, Japan

[73] Assignee: Asahi Glass Company Ltd., Tokyo, Japan

[21] Appl. No.: 644,823

[22] Filed: May 10, 1996

[30] Foreign Application Priority Data

May 11, 1995 [JP] Japan ..... 7-113143

[51] Int. Cl.[6] ..... B05D 1/02; B05D 1/34

[52] U.S. Cl. ..... 427/421; 427/426; 427/427; 501/87; 501/100; 501/101

[58] Field of Search ..... 427/421, 426, 427/427; 501/87, 100, 101

[56] References Cited

U.S. PATENT DOCUMENTS

| | | | |
|---|---|---|---|
| 4,001,029 | 1/1977 | Cassens, Jr. . | |
| 4,880,211 | 11/1989 | Head et al. | 266/44 |
| 4,904,503 | 2/1990 | Hilton et al. | 427/373 |
| 4,981,731 | 1/1991 | Yorita et al. | 427/426 |
| 5,246,897 | 9/1993 | Ono et al. . | |
| 5,628,940 | 5/1997 | Allison | 427/426 |

FOREIGN PATENT DOCUMENTS

| | | |
|---|---|---|
| 0 301 092 | 2/1989 | European Pat. Off. . |
| 2 202 053 | 5/1974 | France . |
| 60-86079 | 5/1985 | Japan . |
| 61-101470 | 5/1986 | Japan . |
| 62-36071 | 2/1987 | Japan . |
| 1-224274 | 9/1989 | Japan . |
| 2-27308 | 6/1990 | Japan . |
| 2 100 327 | 12/1982 | United Kingdom . |
| WO 96/01700 | 1/1996 | WIPO . |

*Primary Examiner*—Shrive Beck
*Assistant Examiner*—Bret Chen
*Attorney, Agent, or Firm*—Oblon, Spivak, McClelland, Maier & Neustadt, P.C.

[57] ABSTRACT

A spray operation method for monolithic refractories, which comprises forcibly sending to an application field by a force feed pump and a force feed piping a self flowable mixed batch prepared by mixing, together with water, a powder composition for monolithic refractories comprising refractory aggregates, a refractory powder and a small amount of a dispersant; injecting into the mixed batch, compressed air and a required amount of a rapid setting agent respectively from a compressed air injection inlet and a rapid setting agent injection inlet provided at a downstream portion or downstream portions of the force feed piping; sending the mixed batch together with the compressed air by a nozzle piping to a spray nozzle attached to the forward end of the nozzle piping; and spraying the mixed batch from the spray nozzle to an application site.

10 Claims, 1 Drawing Sheet

SPRAY OPERATION METHOD FOR MONOLITHIC REFRACTORIES

BACKGROUND OF THE INVENTION

1. Field of the Invention

The present invention relates to a spray operation method for monolithic refractories, whereby monolithic refractories having high bulk densities can be obtained.

2. Description of the Related Art

The spray operation method for monolithic refractories requires no formwork and no casting and thus has a merit that the manpower of formwork can be saved in the application operation as compared with a casting operation method. Accordingly, spray application for monolithic refractories has already been practically used. However, conventional spray operation methods are so-called dry or semiwet spray operation methods, wherein a non-flowable mixed batch, i.e. a mixed batch composed of a dry powder composition for monolithic refractories or a powder composition for monolithic refractories having water mixed in such an amount as not to impart flowability, is transported to the application field by piping having compressed air as a carrier and applied by spraying from a spray nozzle while injecting all necessary water or supplemental amount of water required by the monolithic refractories, and a rapid setting agent at the spray nozzle.

However, by such spray operation methods, fine refractory powder particles of e.g. less than 0.1 mm in the powder composition for monolithic refractories tend to be applied in an inadequately dispersed state, and a large amount of air tends to be included in the applied monolithic refractories. As a result, the resulted monolithic refractories will have a high porosity (a low bulk density) as compared with monolithic refractory products prepared by casting, and as the porosity is high, they tend to be inferior in the properties such as corrosion resistance, which are required for refractories.

Japanese Examined Patent Publication No. 27308/1990 or Japanese Unexamined Patent Publication No. 36071/1987 proposes a method wherein a certain amount of water is preliminarily mixed to wet the powder composition for monolithic refractories to prevent generation of a large amount of dust at the time of the application operation, and the supplemental amount of water and an aqueous solution of a rapid setting agent are injected at a spray nozzle. However, the amount of water to be preliminarily mixed to the powder composition for monolithic refractories, is limited so that the piping for an air stream transportation will not be clogged with the mixed batch for monolithic refractories, whereby inclusion of air in the product can not be avoided. Further, there has been an operational environmental problem such that a substantial amount of rebound loss results during the spray application operation, and the dust is scattered around the operation site.

Even if the supplemental amount of water is injected to the wet mixed batch at the spray nozzle, the distribution of water in the mixed batch to be applied will not to be uniform. Especially when monolithic refractories having a fine powder with a particle size of 1 μm or less mixed to increase the flowability of the mixed batch and to densify the operated body, are to be formed by spray operation, the absolute amount of water to be mixed to the powder composition for monolithic refractories is small and the spray operation has been very difficult.

SUMMARY OF THE INVENTION

It is an object of the present invention to solve the above problems of the prior art and to present a spray operation method for monolithic refractories, which makes further manpower saving during the operation and shortening of the operation time possible and whereby scattering of a dust around the operation site is reduced, and the porosity of the operated body is small, so that the bulk density is high, and the monolithic refractories will be excellent in the properties required for refractories.

The spray operation method for monolithic refractories of the present invention comprises forcibly sending to an application field by a force feed pump and a force feed piping a self flowable mixed batch prepared by mixing, together with water, a powder composition for monolithic refractories (hereinafter referred to simply as a powder composition) comprising refractory aggregates, a refractory powder and a small amount of a dispersant; injecting into the mixed batch, compressed air and a required amount of a rapid setting agent respectively from a compressed air injection inlet and a rapid setting agent injection inlet provided at a downstream portion or downstream portions of the force feed piping; sending the mixed batch together with the compressed air by a nozzle piping to a spray nozzle attached to the forward end of the nozzle piping; and spraying the mixed batch from the spray nozzle to an application site.

BRIEF DESCRIPTION OF THE DRAWINGS

In the accompanying drawing.

DETAILED DESCRIPTION OF THE PREFERRED EMBODIMENTS

Figure 1:
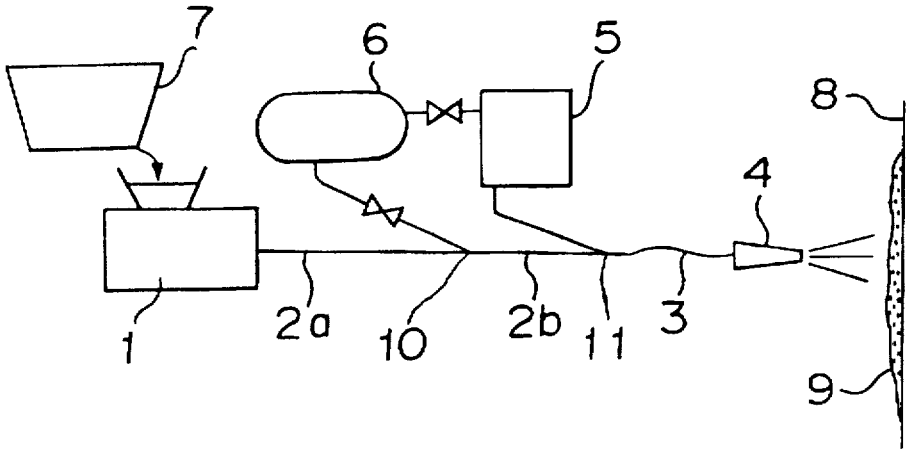
FIG. 1 shows a diagram for the apparatus used for carrying out the spray operation method for monolithic refractories of the present invention.

A feature of the spray operation method of the present invention resides in that a self flowable mixed batch for monolithic refractories is forcibly sent to the application field. In this method, the mixed batch for monolithic refractories having a required amount of water preliminarily mixed, is sent to the application field by a force feed pump and a force feed piping. Further, as the required amount of water is preliminarily mixed, the distribution of water in the mixed batch is uniform, and no substantial air will accompany the powder particles in the mixed batch until the compressed air is injected. Further, air bubbles included when the compressed air as a carrier is injected into the mixed batch, will be discharged mostly from the mixed batch during the spray operation, whereby an operated body of monolithic refractories having a low porosity and a high bulk density comparable to an operated body prepared by casting operation, can be obtained.

In the spray operation method of the present invention, compressed air and a rapid setting agent are injected into the mixed batch, whereupon via a nozzle piping, the mixed batch is sprayed from a spray nozzle to an application site. When the rapid setting agent is injected into the mixed batch, the flowability of the batch rapidly decreases, whereby even when the mixed batch is sprayed to e.g. a vertical or overhead wall surface, it can be applied without flowing off from the wall surface.

Further, the spray nozzle is attached to a forward or downstream end of the nozzle piping extending from the downportion of the force feed piping whereon the rapid setting agent injection inlet is provided. Thus, only one pipe is connected to the spray nozzle, whereby the spray nozzle can be easily moved. Preferably, the nozzle piping has a length of 30 cm –2 m and is made of a flexible pipe, so that the nozzle piping can readily be bent. More preferably, the length of the nozzle piping is at least 1 meter, so that up and down movement as well as right to left movement of the spray nozzle by manual operation can be facilitated, and the spray operation can be made easy.

The injection inlet for the rapid setting agent is preferably located downstream from the injection inlet for the compressed air, although they are located at the same downstream portion of the force feed piping. The rapid setting agent is injected for the purpose of rapidly curing the mixed batch. Therefore, when the rapid setting agent is injected before the mixed batch is blown by the injected compressed air into small pieces suitable for spraying, the mixed batch will likely reach the spray nozzle in a state not reduced into small pieces. If this phenomenon occurs, the spray nozzle is likely to be clogged by the mixed batch. To prevent such a phenomenon, it is preferred to have a distance of at least one meter secured between the compressed air inlet and the rapid setting agent inlet. The distance between the compressed air inlet and the spray nozzle is preferably at least 3 meters. Thus, the rapid setting agent will be uniformly dispersed in the mixed batch reduced into small pieces by injection of the compressed air into the mixed batch, whereby the spray operation can be carried out under a stabilized condition.

In the present invention, the flowability of the mixed batch is evaluated by means of a cone mold at a room temperature of about 20° C. Namely, the mixed batch immediately after mixing the powder composition together with water at about 20° C., is fed to fill a truncated cone mold having open upper and lower ends and having an upper end inner diameter of 50 mm, a lower end inner diameter of 100 mm and a height of 150 mm, and then the cone mold is withdrawn upward, whereupon the mixed batch is left to stand still for 60 seconds, whereby the flowability is represented by the spread diameter (the mean value of the spread diameters measured in two directions, which will be hereinafter referred to as a flow index).

The mixed batch exhibits self flowability when the flow index is at least 165 mm. The flow index of the mixed batch increases as the amount of water incorporated, increases. The flow index of the mixed batch to be sent by the force feed pump is preferably at least 180 mm, more preferably at least 200 mm, so that the mixed batch can easily and without retention be sent to the application field by the force feed pump and the force feed piping. By using a mixed batch having a large flow index, the suction resistance in the force feed pump and the flow resistance in the force feed piping can be made small, whereby the diameter of the force feed piping can be made small, and a long distance force feed transportation of the mixed batch can be made easy.

The powder composition to be used in the present invention comprises refractory aggregates, a refractory powder and a small amount of a dispersant. The refractory powder fills the spaces of the refractory aggregates and constitutes a binder portion for binding the particles of the refractory aggregates in resulted monolithic refractories.

As the refractory aggregates, at least one type of aggregates selected from the group consisting of alumina, bauxite, diaspore, mullite, aluminous shale, shamotte, silica rock, pyrophillite, sillimanite, andalusite, chromite, spinel, magnesia, zirconia, zircon, chromia, silicon nitride, aluminium nitride, silicon carbide, boron carbide, carbon such as graphite, titanium boride and zirconium boride, is preferably employed.

Further, in order to impart good refractory properties to the operated body, the powder composition preferably contains at least 20 parts by weight of coarse particles of refractory aggregates having a particle size of at least 1.68 mm in 100 parts by weight thereof.

The refractory powder is preferably at least one member selected from the group consisting of aluminous cement, alumina, titania, bauxite, diaspore, mullite, aluminous shale, shamotte, pyrophillite, sillimanite, andalusite, silica rock, chromite, spinel, magnesia, zirconia, zircon, chromia, silicon nitride, aluminium nitride, silicon carbide, boron carbide, zirconium boride, titanium boride and amorphous silica such as fumed silica. Further, the refractory powder is preferably a powder having an average particle size of at most 30 μm.

It is preferred to incorporate, as a part of such a refractory powder, a fine powder of e.g. alumina or fumed silica having a particle size of at most 3 μm, preferably at most 1 μm, in an amount of at most 12 wt % in the total amount of the refractory aggregates and the refractory powder in the composition, whereby it is possible to impart good flowability to the mixed batch, and it is possible to further reduce the amount of the water to be added to the composition. Good flowability can be imparted to the mixed batch also by using a powder composed of spheroidized particles having a mean particle size of at most 30 μm, as a part of the refractory powder. Further, when aluminous cement is used as a part of the refractory powder, the aluminous cement serves as a binder for the monolithic refractories, whereby strength can be imparted to the operated body within a wide temperature range from room temperature to a high temperature.

As a means to impart good self flowability to the mixed batch, it is preferred to incorporate to the powder composition a powdery dispersant properly selected depending upon the types of the refractory aggregates and the refractory powder used. The dispersant is preferably at least one member select from the group consisting of polymetaphosphite salts, poly-carboxylate salts, poly-acrylate salts and β-naphtalensulfonate salts. It is preferably incorporated in an amount of from 0.02 to 1 part by weight to 100 parts by weight of the total amount of the refractory aggregates and the refractory powder in the powder composition.

The amount of water to be added to 100 parts by weight of the powder composition, varies depending upon the specific gravity or the porosity of the aggregates as the main starting material to be incorporated to the powder composition. However, the amount of water capable of imparting self flowability to the mixed batch, has a lower limit. Namely, water is incorporated in an amount of at least 4 parts by weight to 100 parts by weight of the powder composition (for example, in a case of fused alumina aggregates having a high specific gravity and a low porosity, self flowability can be imparted by 5 parts by weight of water). The powder composition in the form of a dry powder packaged in a bag is transported to a location near the application field, and the powder composition is mixed by an addition of water to obtain a self flowable mixed batch in a mixer installed near the application field, followed by spray operation. However, if there is a sufficient working time, the powder composition may be mixed by an addition of water in a plant located far from the application field, and the prepared mixed batch may be transported to the field by a concrete mixer car, followed by spray operation.

The water in the mixed batch to be transported by pumping, i.e. the water added to the powder composition, is preferably at most 12 parts by weight, more preferably at most 10 parts by weight, per 100 parts by weight of the powder composition, to minimize the porosity of the applied monolithic refractories and thereby to secure good refractory properties. When water in the mixed batch is small, it is possible to prevent sedimentation of refractory aggregates contained in the mixed batch and thereby to prevent the non-uniformity of the mixed batch, whereby it is possible to form monolithic refractories with a uniform structure having a low porosity, which is excellent in corrosion resistance.

The rapid setting agent to be injected to the mixed batch, may be in the form of an aqueous solution. However, it is preferred to employ a powder in order to secure excellent refractory properties by minimizing the water content in the mixed batch to be used for spray operation. A powder or an aqueous solution of rapid setting agent is preferably injected into the mixed batch from the rapid setting agent injection inlet using compressed air as the carrier. In this case a part or whole compressed air in an air compressor 6 may be used by opening valve 12 and controlling or closing valve 13 in FIG. 1. The compressed air injection inlet 10 may be omitted when all of the compressed air in an air compressor 6 is used. When the aqueous solution of the rapid setting agent is to be injected to the mixed batch, it is preferred to use a highly concentrated aqueous solution. In order to disperse the rapid setting agent uniformly, it is preferred to inject the rapid setting agent into the mixed batch in such a state that it is blown by the compressed air to float in the air stream.

As the rapid setting agent, it is possible to employ at least one member selected from the group consisting of an aluminate such as sodium aluminate, potassium aluminate or calcium aluminate, a carbonate such as sodium carbonate, potassium carbonate, sodium hydrogen carbonate or potassium hydrogen carbonate, a sulfate such as potassium sulfate or magnesium sulfate, a calcium aluminate such as $CaO.Al_2O_3$, $12CaO.7Al_2O_3$, $CaO.2Al_2O_3$, $3CaO.Al_2O_3$, $3CaO.3Al_2O_3.CaF_2$ or $11CaO.7Al_2O_3.CaF_2$, calcium oxide, calcium hydroxide, and mixtures thereof. The required amount of the rapid setting agent varies depending upon the type of the rapid setting agent. Accordingly, the amount to be injected is preferably adjusted taking into consideration the type of the rapid setting agent, the length of the nozzle piping after injection of the rapid setting agent, etc.

Among these rapid setting agents, it is preferred to use sodium aluminate, since it is readily available and inexpensive, and its rapid setting properties are stable. Sodium aluminate has a high melting point, whereby flame resistance of the refractories will not be substantially decreased, and when injected into the mixed batch, it undergoes hydrolysis to form a gel of $Al(OH)_2$ as well as NaOH, whereby the mixed batch will be rapidly cured.

The amount of the rapid setting agent to be injected, is preferably from 0.05 to 3 parts by weight, by dry base, to 100 parts by weight of the powder composition excluding water and the dispersant. When the amount is less than 0.05 part by weight, the setting speed tends to be inadequate, and the applied mixed batch is likely to flow off, even if a highly effective rapid setting agent is employed. On the other hand, when the injected amount exceeds 3 parts by weight, the curing tends to be so rapid that the spray operation tends to be difficult, and refractory properties such as heat resistance and corrosion resistance tend to deteriorate.

As the force feed pump, it is preferred to employ a piston pump or a squeeze pump, since such a pump is readily available as a convenient commercial product. The squeeze pump is a diaphragm pump wherein a diaphragm is operated by compressed air, or a pump wherein a tube is squeezed by rollers to forcibly transport the mixed batch. As such a force feed pump, to minimize pulsating flow of the mixed batch to be transported, it is preferred to use a force feed pump equipped with a plurality of diaphragms, a plurality of tubes or a plurality of pistons.

Further, by an addition of from 0.002 to 0.2 part by weight of a retarder to 100 parts by weight of the powder composition, the working time of the mixed batch can be prolonged, whereby even in a summer time where the atmospheric temperature is high, an adequate working time can be secured, and spray operation for refractories can be conducted under a stabilized condition. As the retarder, a weak acid such as oxalic acid, boric acid, malonic acid or citric acid, is preferably employed.

Further, by using a stout piping at the upper stream portion of the force feed piping and providing a tapered steel pipe immediately upstream from the compressed air injection inlet at the downstream portion, so that a slender piping is connected to the tapered steel tube, the load of the force feed pump for forcibly sending the mixed batch can be reduced, whereby stabilized force feeding of a large amount of the mixed batch can be made possible. Further, it is preferred not to form a stepped portion inside of the force feed piping to minimize the flow resistance of the mixed batch to be forcibly transported. Monolithic refractories in which shamotte or bauxite is used as refractory aggregates in the composition, are commonly useful and have a wide range of applications.

Now, the present invention will be described in further detail with reference to Examples. However, it should be understood that the present invention is by no means restricted to such specific Examples. h

EXAMPLES 1 TO 4, 1' AND 2'

As refractory aggregates, shamotte aggregates were used which had $Al_2O_3$, $SiO_2$ and $Fe_2O_3$ contents of 43 wt%, 53 wt % and 0.9 wt %, respectively, and which comprised coarse particles having a particle size of from 1.68 to 5 mm and intermediate particles having a particle size of from 0.1 to 1.68 mm.

As a refractory powder constituting the binder portion of refractories, the above shamotte powder having a particle size of from 20 to 100 μm and a mean particle size of 30 μm, aluminous cement having $Al_2O_3$ and CaO contents of 55 wt % and 36 wt %, respectively, and having a mean particle size of 9 μm, Bayer's alumina having an $Al_2O_3$ purity of 99.6 wt % and having a mean particle size of 4.3 μm, and fumed silica having a $SiO_2$ purity of 93 wt % and having a mean particle size of 0.8 μm, were employed. Further, as a dispersant, a powder of sodium tetrapolyphosphate having $P_2O_5$ and $Na_2O$ contents of 60.4 wt % and 39.6 wt %, respectively, was employed. The refractory aggregates, the refractory powder and the dispersant were blended to obtain powder compositions as identified in Table 1. To each composition, water was added in an amount as identified in Table 1(with respect to the refractory aggregates and the refractory powder, the indicated amounts are wt % based on the total amount, and with respect to other materials, the indicated amounts are parts by weight, per 100 parts by weight of the sum of the refractory aggregates and the refractory powder), and the mixture was mixed for 3 minutes in a Boltex mixer with a capacity of 500 kg (manufactured by Kitagawa Tettukousha Co., Ltd.) to obtain a self flowable mixed batch. The flowability of each mixed batch was measured in accordance with the above described method, whereupon the flow index (mm) was determined.

Used as a rapid setting agent was a mixture comprising a powder of sodium aluminate (containing about 20% of water of crystallization) having a particle size of at most 800 μm and a mean particle size of about 150 μm and a powder of sodium carbonate in a weight ratio of 3:1, and a mixed batch having the composition as identified in Table 1, was prepared and used for spray operation. Namely, using a spray apparatus as shown in the diagram of FIG. 1, spray operation was carried out to form an operated body in a thickness of about 100 mm on a wall surface (no anchor provided) of a vertical iron plate. Unless otherwise specified, these tests were carried out in a room of about 20° C. by an addition of water of about 20° C. to the composition.

In FIG. 1, reference numeral 1 indicates a force feed pump, numerals 2*a* and 2*b* force feed pipings, numeral 3 a nozzle piping, numeral 4 a spray nozzle, numeral 5 a feeder for a rapid setting agent, numeral 6 an air compressor, numeral 7 a container for a mixed batch, provided with a mixing means, numeral 8 a wall surface to which spray operation is applied, and numeral 9 an operated body formed by spray operation. In the following Examples, a force feed pump BSA702 equipped with two pistons, manufactured by Putzmister Company, was used as the force feed pump. The force feed flow rate was about 3 tons of the mixed batch per hour, and compressed air adjusted to a level of from 4 to 6 atm was injected from the compressed air injection inlet, whereby the mixed batch was supplied to the spray nozzle.

To inject a powdery rapid setting agent quantitively to the mixed batch, a Q gun equipped with a table feeder, manufactured by Plibrico Japan Co., and the amount of the rapid setting agent injected was adjusted as shown in Table 1 by controlling the air pressure within a range of from 3 to 4 $kg/cm^2$.

In the spray apparatus used in the above Examples, the downstream portion of the force feed piping 2*a*(a steel pipe having a diameter of 65A (2.5B) and a length of about 70 m)located immediately upstream from the compression air injection inlet 10, is made of a tapered steel pipe having a length of 1 meter, which was tapered from 65A to 50A (2B), and the force feed piping 2*b* extending from the compressed air injection inlet 10 to the rapid setting agent injection inlet 11, was made of a rubber hose having a diameter of 50A and a length of 3m. Likewise, the nozzle piping 3 extending from the rapid setting agent injection inlet 11 to the spray nozzle 4 was made of a rubber hose having a diameter of 50A and a length of 1.2 m. The force feed pipings 2*a*, 2*b* were connected so that no stepped portion was formed at the connected portion inside of them, to minimize the flow resistance. Further, a Y-shaped tube was attached to each of the compressed air injection inlet 10 and the rapid setting agent injection inlet 11.

The spray nozzle 4 shown in FIG. 1 was connected to a flexible nozzle piping 3 i.e. a rubber hose, and therefore it was readily manually manuvable within a range where the rubber hose reached. The spray operation was carried out by an operator who held the spray nozzle 4, and the spray was applied to the wall surface 8.

According to the operation method of the present invention, the mixed batch is a batch in which a required amount of water is mixed, whereby the rebound loss and generation of dust during of the spray operation will be remarkably little, and the operation yield and the operation environment are remarkably superior to the conventional spray operation methods for monolithic refractories.

Further, the compressed air is injected into the mixed batch upstream from the nozzle piping 3, and at least in the nozzle piping 3 at the time of spray operation, air and the mixed batch are present in a mixed state, whereby the nozzle piping 3 is light in weight as compared with the force feed piping 2*a* filled solely with the mixed batch, and thus the nozzle piping 3 is readily maneuverable. When it is necessary to move the force feed piping to the application field for spray operation, it is preferred to take a long distance between the spray nozzle 4 and the compressed air injection inlet 10, for example, a distance of at least 8 m, so that the spray operation which is carried out by bringing the spray nozzle 4 in a restricted application field can be facilitated.

The operated body formed in a thickness of about 100 mm on the wall surface by the spray operation, was left to stand for 24 hours in a chamber of 20° C., and then a test specimen of the operated body having a size of about 30 cm×30 cm was sampled from each operated body. Each sampled test specimen was dried for 24 hours at 110° C., and then the porosity and the bulk density were measured in accordance with the methods stipulated in JIS R2205. In Table 1, Examples 1, 2, 1' and 2' represent the examples of the present invention.

Examples 3 and 4 in Table 1 represent the results obtained with respect to the monolithic refractory bodies molded by casting the mixed batches of Examples 1 and 2, respectively, in a formwork having an inner size of 40 mm×40 mm×80 mm. When Examples 3 and 4 are compared with Examples 1 and 2 in Table 1, it is evident that the physical properties such as the bulk density and compression strength of the monolithic refractory bodies of Examples 1 and 2 formed by the spray operation method of the present invention are comparable to the physical properties of the monolithic refractory bodies of Examples 3 and 4 formed by the casting method. Example 1' represents an example of the present invention in which oxalic acid was added as a retarder to the powder composition of Example 1, and Example 2' represents an example of the present invention in which boric acid was added as a retarder to the powder composition of Example 2.

EXAMPLES 5, 6, 5' and 5"

Table 2 shows the results of the spray tests wherein bauxite refractory aggregates and refractory powder were used instead of the shamotte refractory aggregates and refractory powder. The $Al_2O_3$, $SiO_2$ and $Fe_2O_3$ contents of the bauxite used were 89 wt %, 7 wt % and 1.3 wt %, respectively. The particle size ranges for the coarse particles, the intermediate particles and the powder were adjusted to be the same as in the case of shamotte. However, the mean particle size of the bauxite powder was 20 μm. In Table 2, Example 5 represents an example of the present invention, and Example 6 is a comparative example wherein the same mixed batch was subjected to a casting operation.

Examples 5' and 5" are examples wherein oxalic acid was added as a retarder to the powder composition of Example 5. In Example 5", the test was carried out in summer time at a temperature of about 30° C. From the results of Example 5", it has been found that by incorporating a proper amount of a retarder to the powder composition, it is possible to prolong the working time of the mixed batch, and the spay operation can be conducted under stabilized condition even in summer time at a temperature of 30° C.

TABLE 1

| | 1 | 2 | 3 | 4 | 1' | 2' |
|---|---|---|---|---|---|---|
| Refractory aggregates | | | | | | |
| Shamotte coarse particles | 26 | 27 | 26 | 27 | 26 | 27 |
| Shamotte intermediate particles | 30 | 30 | 30 | 30 | 30 | 30 |
| Refractory powder | | | | | | |
| Shamotte powder | 23 | 21 | 23 | 21 | 23 | 21 |
| Bayer's alumina | 6 | — | 6 | — | 6 | — |
| Fumed silica | 7 | 10 | 7 | 10 | 7 | 10 |
| Aluminous cement | 8 | 12 | 8 | 12 | 8 | 12 |
| Dispersant | 0.1 | 0.1 | 0.1 | 0.1 | 0.1 | 0.1 |
| Retarder | — | — | — | — | 0.01 | 0.03 |
| Rapid setting agent | 0.5 | 0.5 | 0 | 0 | 0.5 | 0.5 |
| Water content | 9 | 10 | 9 | 10 | 9 | 10 |
| Flow index [mm] | 250 | 230 | 250 | 230 | 245 | 220 |
| Pumping efficiency | Good | Good | — | — | Good | Good |
| Adhesion to the wall surface | Good | Good | — | — | Good | Good |
| Flowing off of mixed batch after application | Nil | Nil | — | — | Nil | Nil |
| Cross-sectional texture of operated body | Good | Good | Good | Good | Good | Good |
| Working time of mixed batch [min] | 70 | 90 | — | — | 90 | 180 |
| Apparent porosity [%] | 11 | 12 | 11 | 13 | 11 | 12 |
| Bulk density | 2.25 | 2.21 | 2.26 | 2.23 | 2.26 | 2.22 |
| Compression strength [kg/cm$^2$] | 920 | 840 | 1000 | 900 | 950 | 860 |

TABLE 2

| | 5 | 6 | 5' | 5" |
|---|---|---|---|---|
| Refractory aggregates | | | | |
| Bauxite coarse particles | 31 | 31 | 31 | 31 |
| Bauxite intermediate particles | 25 | 25 | 25 | 25 |
| Refractory powder | | | | |
| Bauxite powder | 23 | 23 | 23 | 23 |
| Bayer's alumina | 7 | 7 | 7 | 7 |
| Fumed silica | 6 | 6 | 6 | 6 |
| Aluminous cement | 8 | 8 | 8 | 8 |
| Dispersant | 0.1 | 0.1 | 0.1 | 0.1 |
| Retarder | — | — | 0.02 | 0.02 |
| Rapid setting agent | 0.5 | 0 | 0.5 | 0.5 |
| Water content | 8 | 8 | 8 | 8 |
| Flow index [mm] | 245 | 245 | 250 | 242 |
| Pumping efficiency | Good | — | Good | Good |
| Adhesion to the wall surface | Good | — | Good | Good |
| Flowing off of mixed batch after application | Nil | — | Nil | Nil |
| Cross-sectional texture of operated body | Good | Good | Good | Good |
| Working time of mixed batch [min] | 60 | — | 120 | 90 |
| Apparent porosity [%] | 12.5 | 12.0 | 12.0 | 12.5 |
| Bulk density | 2.85 | 2.8 | 2.83 | 2.84 |
| Compression strength [kg/cm$^2$] | 1070 | 1050 | 1100 | 1180 |

It is evident from Tables 1 and 2 that according to the spray operation method for monolithic refractories of the present invention, the numerical values of the porosity and the bulk density of the applied bodies thereby obtained, are comparable to the values of the porosity and the bulk density of the monolithic refractory bodies formed by a casting operation. The porosity of at most 12.5% of the spray operated body is remarkably small as compared with the porosity of the monolithic refractories obtained by the conventional spray operation method for monolithic refractories (the porosity of the spray applied monolithic refractory body using shamotte or the like as aggregates, as disclosed in Examples of Japanese Unexamined Patent Publication No. 36071/1987 is at least 16%).

The corrosion resistance which is an important property for practical use of refractories, is substantially influenced by the porosity of refractories. According to the spray operation method of the present invention, it is possible to form monolithic refractories having excellent corrosion resistance comparable to monolithic refractory bodies formed by a casting operation.

According to the spray operation method for monolithic refractories of the present invention, spray operation can be carried out under a stabilized condition, and a formwork which is required by a casting operation method, is not required. Thus, the method of the present invention has a merit in that remarkable manpower-saving and shortening of the operation period can be accomplished. Further, a mixed batch having self flowability prepared by mixing the powder composition by an addition of required water, is transported by pumping to carry out the spray operation, whereby it is possible to obtain monolithic refractory bodies which have a porosity remarkably smaller than the porosity of the applied or operated bodies by conventional spray operation method and which has a bulk density comparable to monolithic refractory bodies formed by a casting operation, i.e. excellent corrosion resistance. Such monolithic refractory bodies are distinctly superior in the properties of refractories to monolithic refractory bodies having a large porosity formed by a conventional spray operation method.

Furthermore, the rebound loss during the spray operation is very small (less then about 4 wt %), whereby the operation yield is good, and no substantial dust will be generated, whereby the operation environment is good. To secure the manpower saving and good operation environment is an essential requirement for the continuance and development of this industry in future. Thus, the industrial value of the spray operation method of the present invention is significant.

What is claimed is:

1. A spray operation method for monolithic refractories, which comprises the steps of:

mixing, together with water, a powder composition for monolithic refractories comprising refractory aggregates, a refractory powder and a dispersant, thereby forming a self flowable mixed batch;

forcibly sending the mixed batch to an application field by a pump comprising one of a piston pump and a squeeze pump and a force feed piping;

injecting into the mixed batch, compressed air and a required amount of a rapid setting agent respectively from a compressed air injection inlet and a rapid setting agent injection inlet provided at a downstream portion or downstream portions of the force feed piping;

sending the mixed batch together with the compressed air by a nozzle piping to a spray nozzle attached to the forward end of the nozzle piping; and spraying the mixed batch from the spray nozzle to an application site.

2. The spray operation method for monolithic refractories according to claim 1, wherein the rapid setting agent injection inlet is located at the same portion as or downstream from the compresses air injection inlet.

3. The spray operation method for monolithic refractories according to claim 1, wherein the nozzle piping is made of a flexible pipe.

4. The spray operation method for monolithic refractories according to claim 1, wherein the self flowable mixed batch has a flowability such that when the mixed batch immediately after the mixing is fed to fill a truncated cone mold having open upper and lower ends and having an upper end inner diameter of 50 mm, a lower end inner diameter of 100 mm and a height of 150 mm, then the truncated cone mold is withdrawn upward, and the mixed batch is left to stand still for 60 seconds, the mean spread diameter of the mixed batch is at least 180 mm.

5. The spray operation method for monolithic refractories according to claim 1, wherein the water is added in an amount of at most 12 parts by weight to 100 parts by weight of the powder composition for monolithic refractories.

6. The spray operation method for monolithic refractories according to claim 1, wherein the rapid setting agent is injected in an amount of from 0.05 to 3 parts by weight, on dry base, to 100 parts by weight of the powder composition for monolithic refractories.

7. The spray operation method for monolithic refractories according to claim 1, wherein the rapid setting agent to be injected into the mixed batch is in the form of a powder.

8. The spray operation method for monolithic refractories according to claim 1, wherein aluminous cement is used as a part of the refractory powder.

9. The spray operation method for monolithic refractories according to claim 1, wherein a retarder is added in an amount of from 0.002 to 0.2 part by weight, on dry base, to 100 parts by weight of the powder composition for monolithic refractories.

10. The spray operation method for monolithic refractories according to claim 1, wherein a tapered steel pipe is provided at a downstream portion of the force feed piping immediately upstream from the compressed air injection inlet.

* * * * *